US006990758B1

(12) United States Patent
Holmes et al.

(10) Patent No.: US 6,990,758 B1
(45) Date of Patent: Jan. 31, 2006

(54) SCRAPER AND RAKE ATTACHMENT FOR EXCAVATOR BUCKET

(76) Inventors: David C. Holmes, 841 E. Pickering Rd., Shelton, WA (US) 98584; Frederick J. Holmes, 841 E. Pickering Rd., Shelton, WA (US) 98584

( * ) Notice: Subject to any disclaimer, the term of this patent is extended or adjusted under 35 U.S.C. 154(b) by 0 days.

(21) Appl. No.: 11/052,281

(22) Filed: Feb. 8, 2005

(51) Int. Cl.
*E02F 3/96* (2006.01)

(52) U.S. Cl. ..... 37/405; 37/903; 414/912; 414/724; 172/252; 172/253; 172/817

(58) Field of Classification Search ..... 37/403–410, 37/466, 444; 414/912, 724, 722; 172/245, 172/247, 250, 252, 253, 817; 171/63, 43, 171/144
See application file for complete search history.

(56) References Cited

U.S. PATENT DOCUMENTS 3,967,397 A 7/1976 Nault
4,125,952 A 11/1978 Jennings
4,271,614 A 6/1981 Albrecht
5,544,435 A 8/1996 Somero
6,088,939 A 7/2000 Logan
6,360,458 B2 3/2002 Dollister
6,718,662 B1 4/2004 Schaff

*Primary Examiner*—Christopher J. Novosad
(74) *Attorney, Agent, or Firm*—Richard C. Litman

(57) ABSTRACT

A heavy-duty scraping and rake attachment for excavator buckets for clearing brush-covered earth. The attachment is easily mountable to the bucket, thus avoiding the work and expense of removing the bucket from the arm. The scraper portion provides for offset toothed scrapers, a combination of toothed scraper and blade, and blade only use and is used in conjunction with a heavy-duty rake and power-operated thumb to grasp and remove the material rooted or scraped up from the earth by the scraper. The scraper portion and rake are included in a single unit, attachable and detachable from the excavator bucket. Scraper and blade attachments either detachably connected to the unit with bolts or permanently welded in place as desired.

20 Claims, 8 Drawing Sheets

SCRAPER AND RAKE ATTACHMENT FOR EXCAVATOR BUCKET

BACKGROUND OF THE INVENTION

1. Field of the Invention

The present invention relates to earth moving and clearing equipment. More particularly, the present invention relates to a rake and scraper attachment system for an excavator bucket.

2. Description of the Related Art

Power operated excavators having bucket mounted arms are in wide use in earthmoving and digging operations. They are most useful in earth digging and clearing operations. Rake attachments have been provided as attachments to a bucket. Such rakes are useful in clearing earth for construction and the like. They lack, however, the ability to scrape the earth surface prior to grasping brush between the bucket mounted rake of an excavator and the thumb during the clearing process.

It would be desirable to provide an easily mounted heavy-duty scraper and rake system for attachment to an excavator bucket having a power operated thumb which attaches and detaches to the excavator bucket and which also provides a choice of scraping mechanisms for ground scraping for ground clearing, the rake operating with the thumb to grasp and remove the material rooted up by the scraping mechanism, thus providing a comprehensive ground clearing system for excavators which does not require the removal of the bucket to install.

Thus, a multipurpose, heavy-duty scraping and rake attachment for excavator buckets solving the aforementioned problems is desired.

SUMMARY OF THE INVENTION

The multipurpose heavy-duty scraping and rake attachment for excavator buckets of the present invention is efficient and effective in clearing brush-covered earth. The system is easily mountable to the bucket, thus avoiding the work and expense of removing the bucket. The scraper portion provides for offset saw-toothed scrapers, a combination of toothed scraper and straight blade (mini-blade), and blade only use and is used in conjunction with a heavy-duty rake and power-operated thumb to grasp and remove the material rooted or scraped up from the earth by the scraper. The scraper portion and rake are included in a single unit easily attachable and detachable from the excavator bucket. Scraper and blade attachments may be either detachably connected to the unit with bolts or permanently welded in place as desired. A spike-toothed rake or scraper may also be attached in place of the straight blade.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention multipurpose heavy-duty scraping and rake attachment for excavator buckets of the present invention is easily mounted and removed from the bucket and is efficient and effective in clearing brush-covered earth and other uses.

Figure 1:
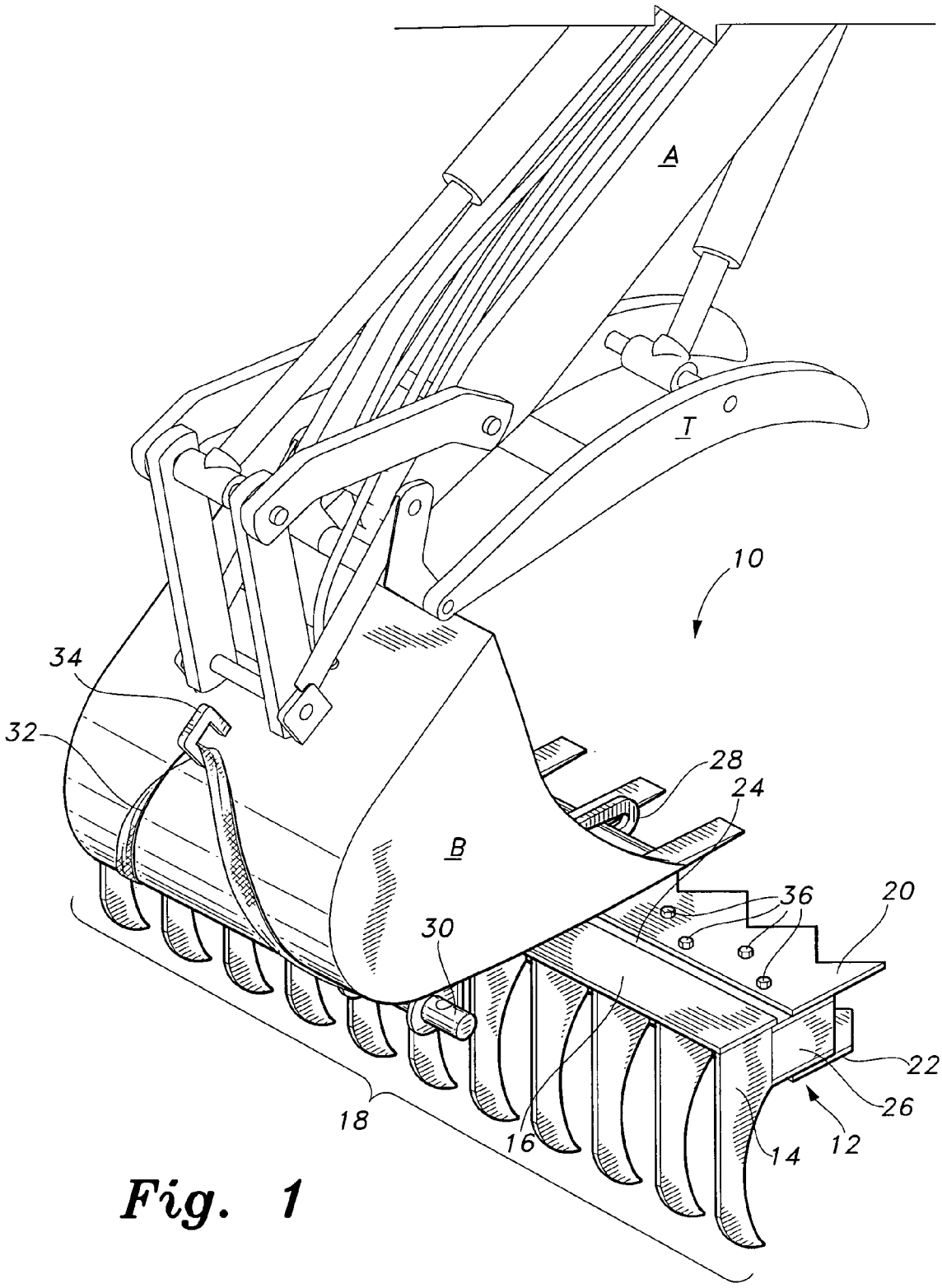
FIG. 1 is an environmental, perspective view of a scraper and rake attachment system for an excavator bucket according to the present invention.

Referring to FIG. 1, there is shown an environmental perspective view of the scraping and rake attachment system of the present invention as attached to the bucket B having a grasping thumb T and attached to the arm A of a conventional earth excavator. The scraping and rake attachment system 10 includes a rake an blade unit 12 having forward heavy-duty rake 14 extending laterally relative to bucket 12 and having a rake tooth rear support 16 extending along the unit 12 adjacent bucket B having spaced teeth 18 spaced therealong. Teeth 16 are generally hooked inwardly so as to act with thumb T to grasp brush and the like and lift it from the site.

Forward saw-tooth blade 22 and rear saw-tooth blade 22 are shown with teeth offset relative to each other and attached to mounting box 24 having end walls 26 by mounting bolts 36. Either or both saw-tooth blades 20 and 22 may be permanently welded to mounting box 24 as desired. Rake and blade unit 12 is removably attached to the digging blade of bucket B by bucket engagement hook rods 28 which hook over the entrance to the bucket relative the scraping blades 20 and 22 and mounting box 24. A securing system 29 includes a winch 30 adjustably receiving bucket securing strap 32 which extends from winch and shackle mounting bracket 40 (see FIG. 2) and runs through centrally located bucket strap receiver 34 mounted to the upper portion of bucket B as by welding. Bolts 36 allow removal and replacement of saw-tooth blades 20 and 22 with other types of blades as described below.

Figure 2:
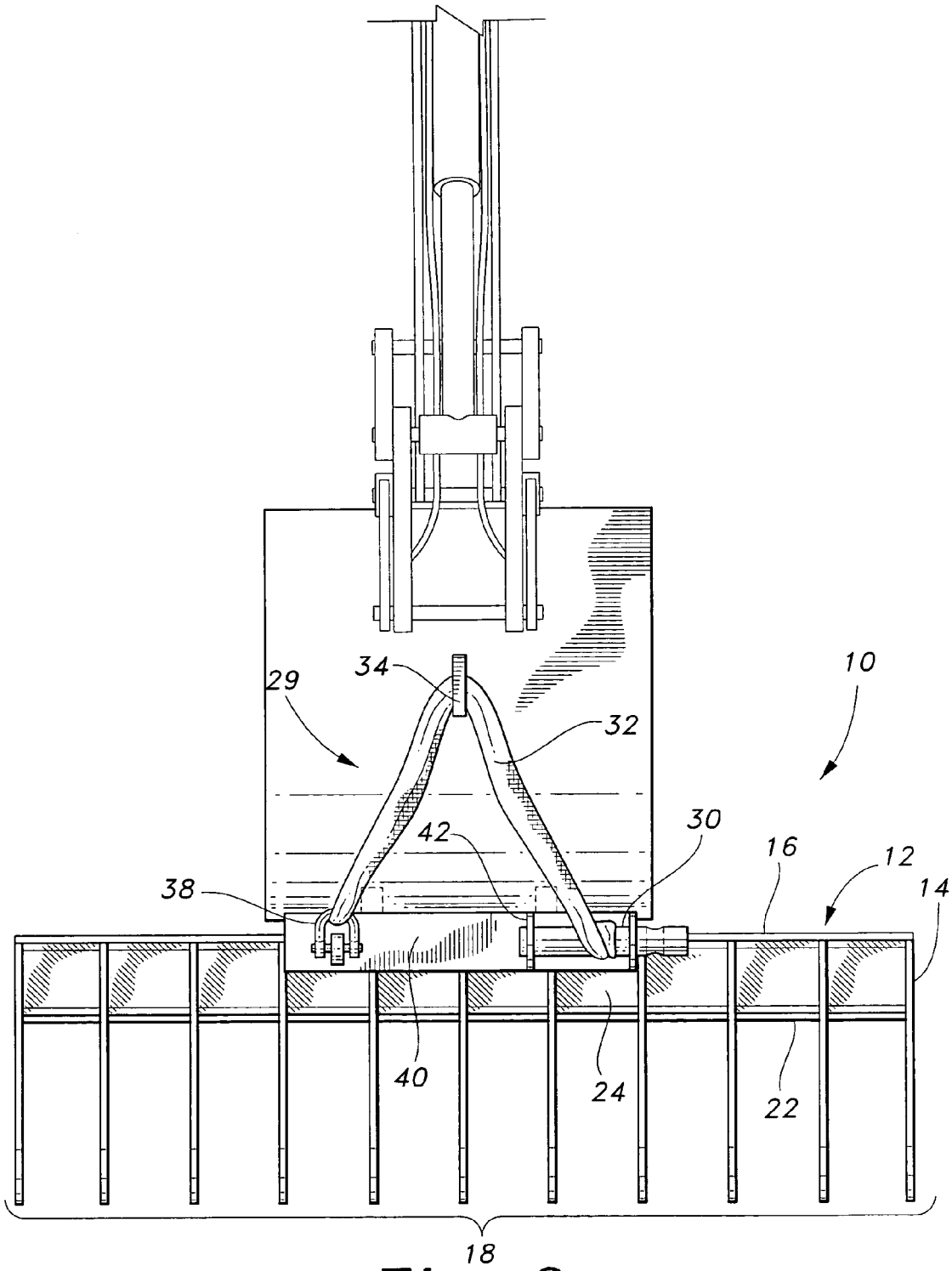
FIG. 2 is an environmental front elevation of the system of FIG. 1.

Referring to FIG. 2, there is shown an environmental front elevation view of the rake and blade unit 12 having winch and shackle mounting bracket attached at the upper front of the centrally mounted blades 18. Securing system 29 includes strap 32, shown running through bucket strap receiver 34 and having one end secured by shackle 38 to one end portion of mounting bracket 40 and its other end attached to winch 30 supported for rotation by winch bracket 42 mounted at the other end portion of mounting bracket 40.

Figure 3:
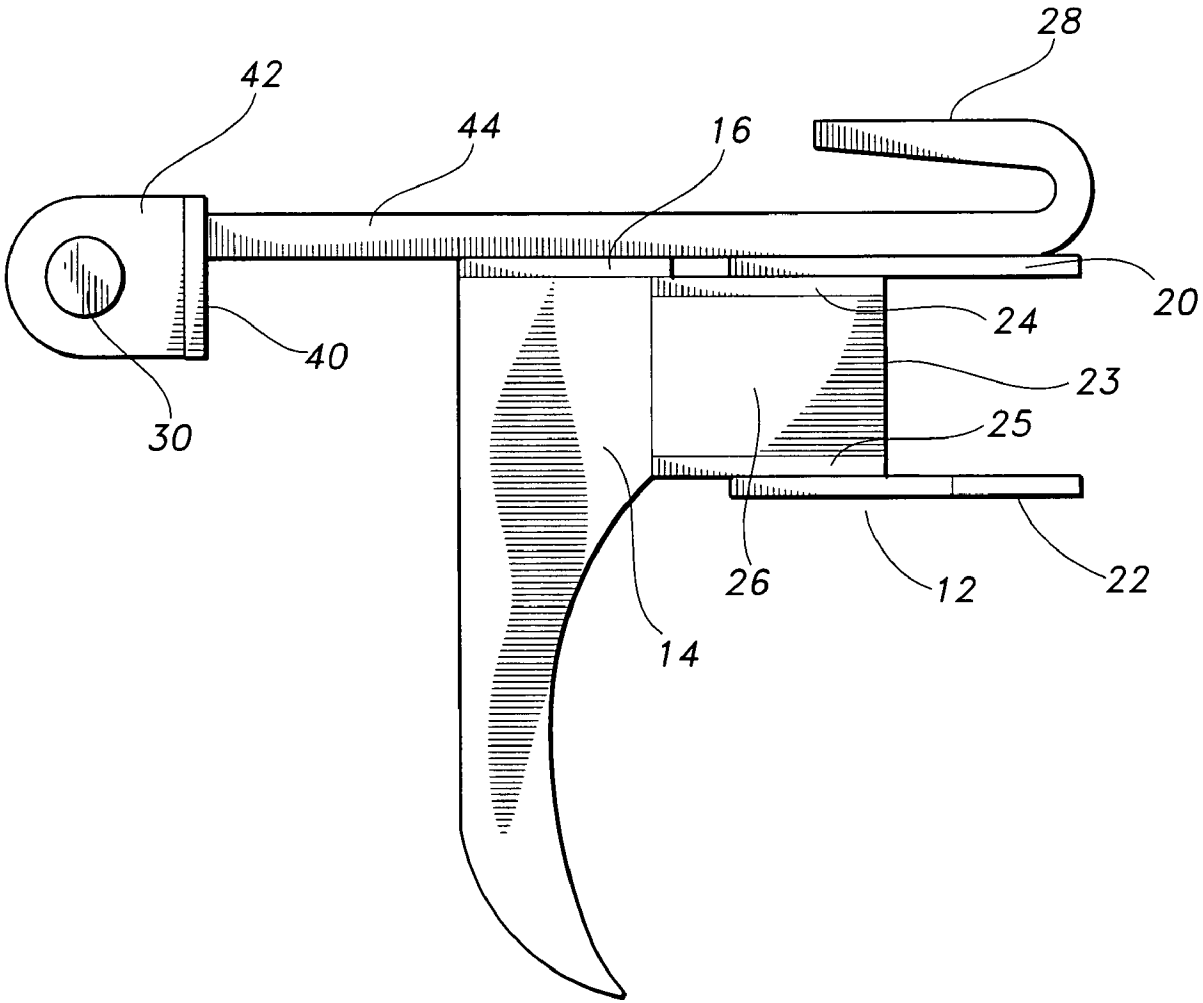
FIG. 3 is a side elevation view of the system of FIG. 1.
Figure 4:
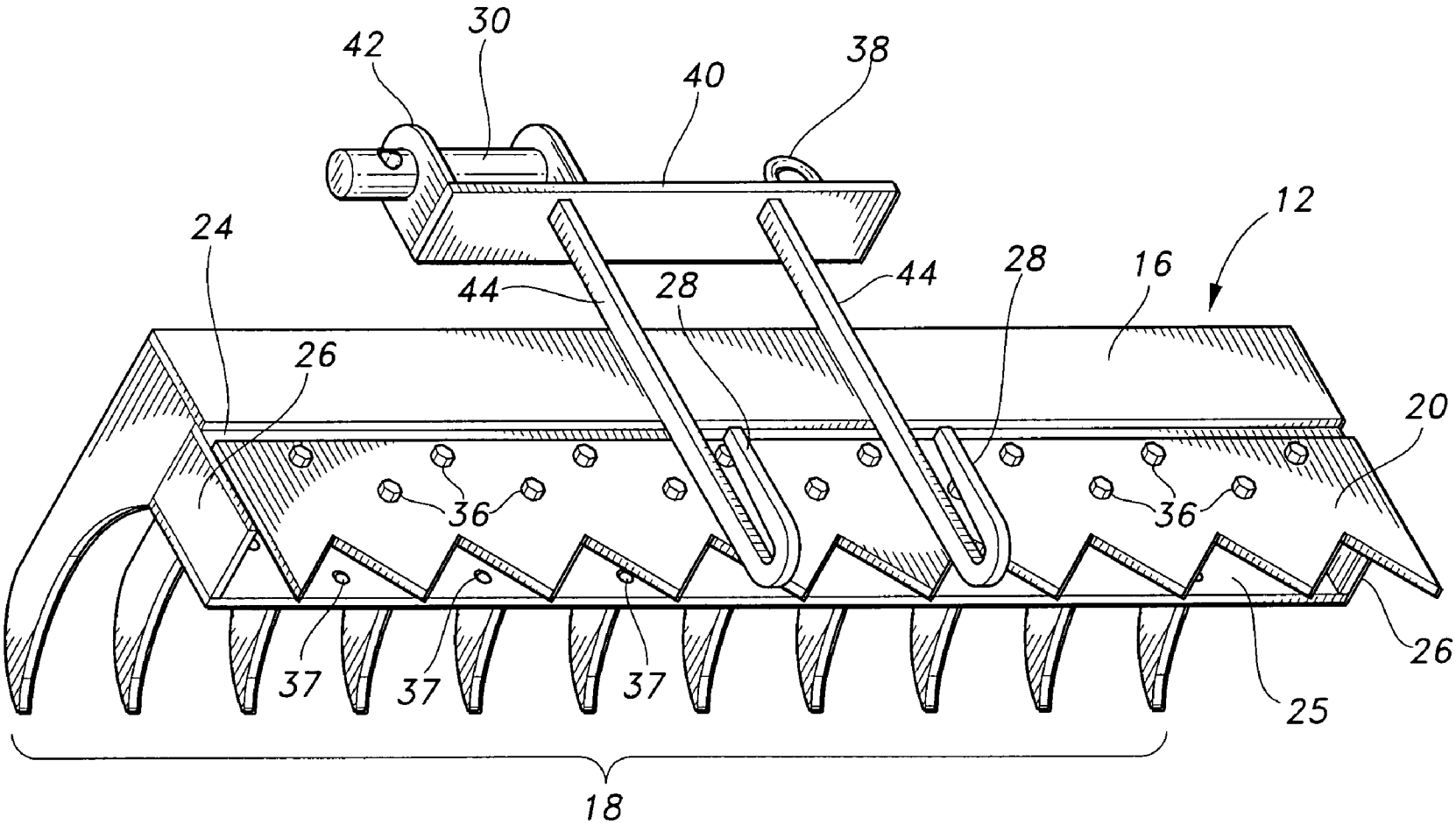
FIG. 4 is a rear perspective view of the system of FIG. 1.

Referring to FIGS. 3 and 4, there are shown a side elevation view and a rear perspective view, respectively, of the rake and blade unit 12 with rear forward saw-tooth blade 20 removed leaving mounting bores 37 in mounting box 24. Mounting bolts 36 extend laterally along the attachment portion of blade 22 in two staggered rows as shown. Shanks 44 of spaced bucket engagement hook rods 28 are attached to the upper surface of rake tooth rear support 16 as by welding and serve as a connection for winch and shackle mounting bracket 42. Upon removal of mounting bolts 36, forward saw-tooth blade 20 may be slid out from between shank 44 and blade tooth rear support 16 for removal and replacement.

Figure 5:
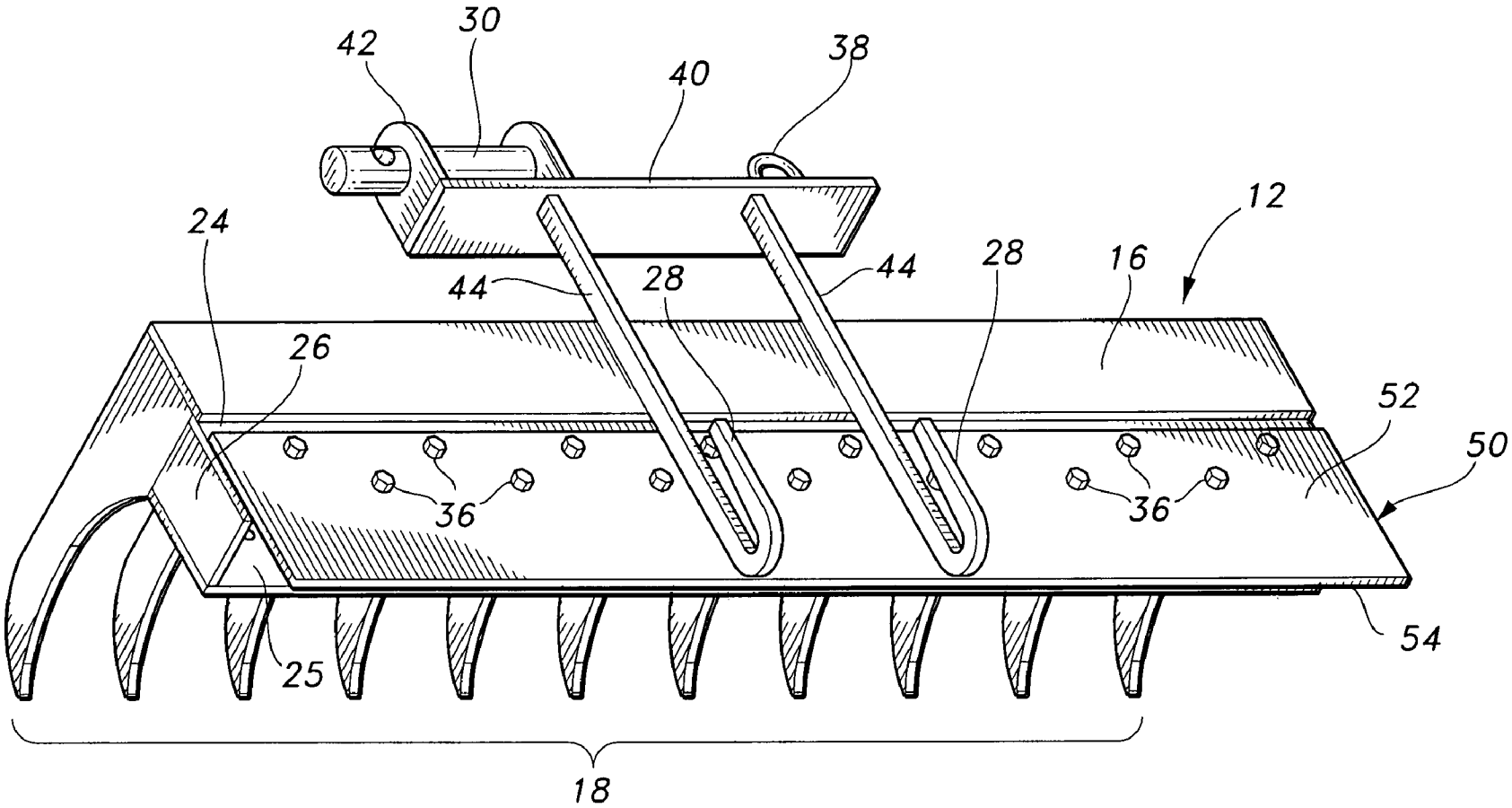
FIG. 5 is a rear perspective view similar to FIG. 4 with a straight blade bolted in place.

Referring to FIG. 5, there is shown a rear perspective view of the rake and blade unit 12 having a straight blade (mini-blade) attachment 50 in place having a blade 52 held by mounting-bolts 36 and having a straight blade edge 54. Straight blade attachment 50 replaces the forward saw tooth blade 20 as described above and may be used with or without (as shown) saw-tooth blade 22. Straight blade 54 leaves a smoother earth surface when its use is appropriate.

Figure 6:
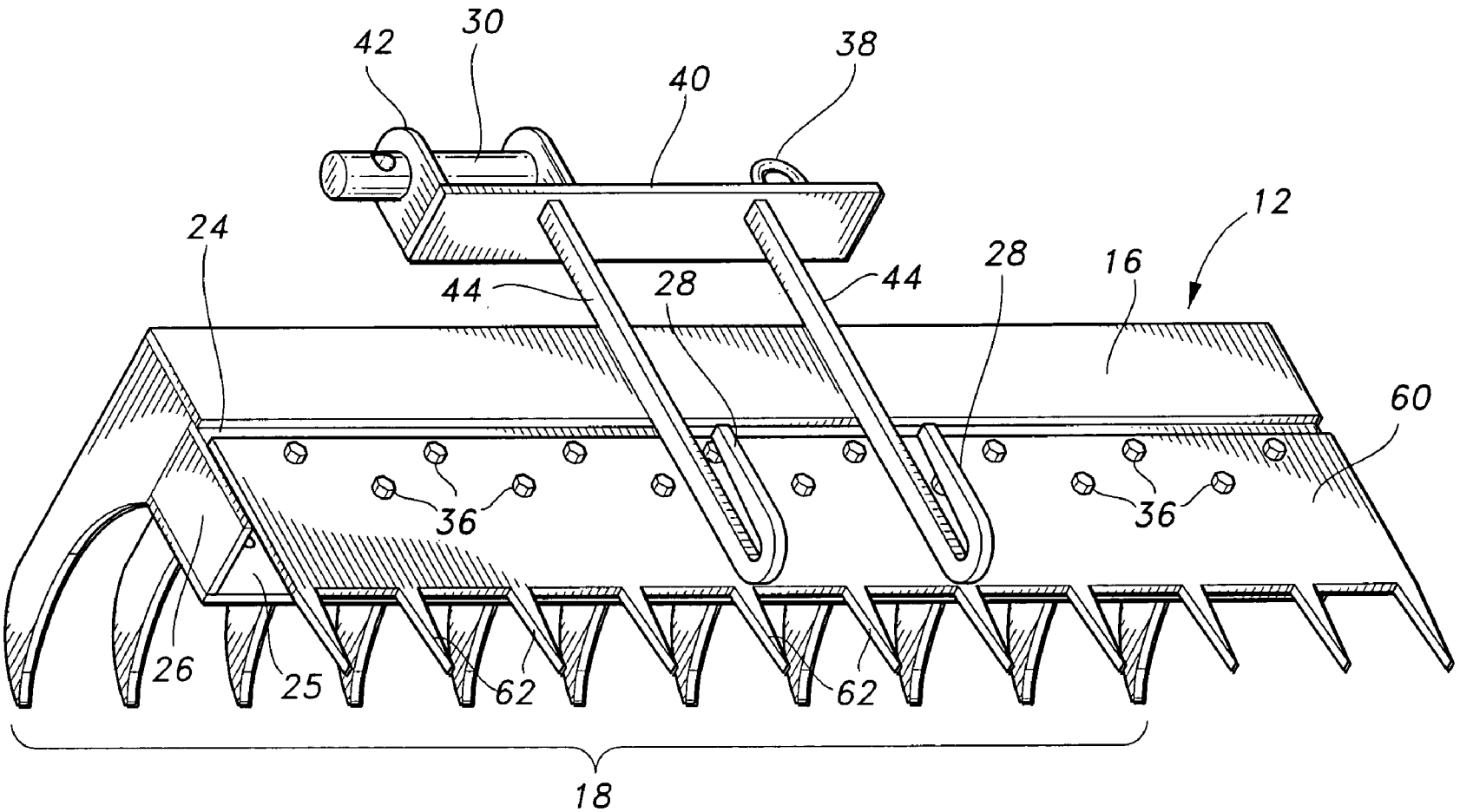
FIG. 6 is a rear perspective view similar to FIG. 4 with the spiked rake or blade bolted in place.

Referring to FIG. 6, there is shown a rear perspective view of the rake and blade unit 12 having a spiked rake or blade attachment 60 in place held by mounting-bolts 36 and having spaced spikes 62 extending outward therefrom. Spiked blade attachment 60 replaces the forward saw tooth blade 20 as described above and may be used with or without (as shown) saw-tooth blade 22. Spiked blade 54 provides a deeper rooting action when its use is appropriate.

Figure 7:
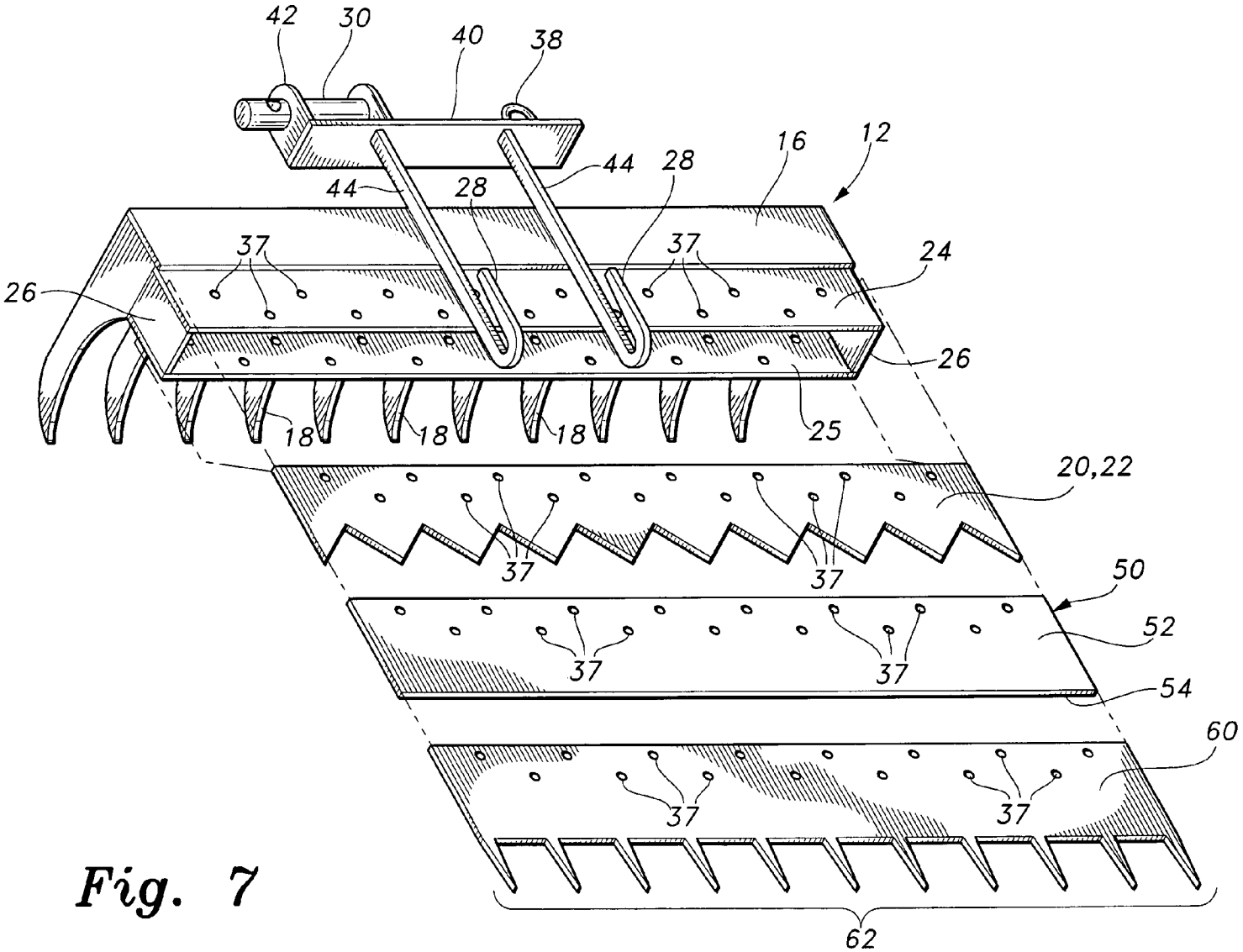
FIG. 7 is a rear perspective view similar to FIG. 4 with attachment blades exploded away.

Referring to FIG. 7, there is shown an exploded view of the scraper and rake attachment system 10 showing the rake and blade unit 12 with replaceable blades 20 and 22, 52, and 60 for mounting on rake and blade unit 12.

Figure 8:
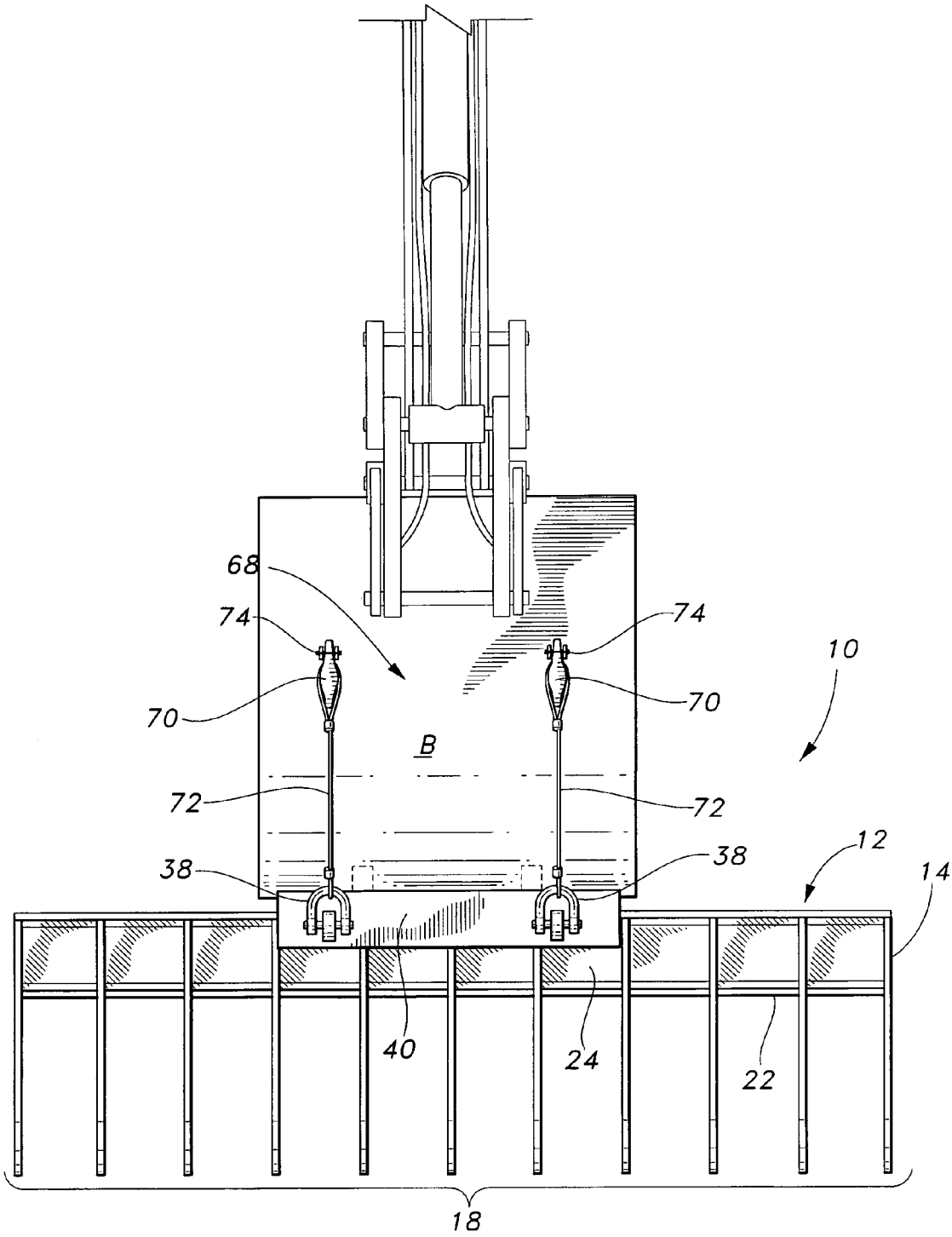
FIG. 8 is an environmental front elevation view of variation of the embodiment of the system of FIG. 1.

Referring to FIG. 8, there is shown an environmental front elevation view of the rake and blade unit 12 having an alternative attachment system 68. Attachment system 68 includes a pair of spaced a pair of spaced cables 72 attached to equally spaced shackles 38 mounted on opposite end portions of mounting bracket 40. Spaced cables 72 are attached to pivot latch handles 70, pivotally attached to the upper front of bucket B. Upon upward rotation of pivot latch handles 70 cables 72 are pulled upward, securing rake and blade unit 12 to bucket B. The pivot latch handles 70 are then secured by inserting the pins in pin-type securing latches 74. The rake and blade unit 12 is released from the front of bucket B by releasing pivot latch handles 70 from securing latches 74 for pivoting downward, relaxing tension on cables 72, lowering rake and blade unit 12.

In operation, scraper and rake unit 12 is mounted on the bucket B upon engagement of the hook rods 28 and the bucket entrance blade and the securing system 29 or 68 attached to the front of the bucket pulls the mounting plate 40 upward into place. Upon operating the arm A of the excavator such as to tilt the bucket forward and lower the bucket said saw-tooth scraper blades 20 and 22 dig and scrape brush and debris from the ground.

Upon operating the arm A of the excavator so as to lift the bucket and tilt the bucket downward, the rake engages the brush and debris and upon closing the grasping thumb of the bucket, the brush and debris is grasped for lifting and transferring to a truck or place of disposal.

It is to be understood that the present invention is not limited to the embodiments described above, but encompasses any and all embodiments within the scope of the following claims.

We claim:

1. A scraper and rake attachment for excavator bucket, comprising:

a laterally disposed rake having a plurality of spaced teeth having an upper tooth attachment back portions, rear attachment portions, and downwardly extending teeth, and a rear support plate, said upper tooth portions being attached along said rear support plate;

a laterally disposed attachment box having an upper wall and forward and rear mounting walls, said tooth back portions being attached along said upper wall of said attachment box;

at least one scraping blade mounted to one of said forward and rear mounting walls;

at least one bucket engagement hook rod having a shank attached perpendicularly to said rake tooth rear support plate and overlapping said rear mounting wall, said hook rod extending over the entrance blade of the bucket;

a mounting bracket centrally attached to said shank of said at least one bucket engagement hook and spaced from said rake; and a securing system mounted to said mounting bracket and the upper forward portion of said bucket;

whereby, said scraper and rake system is mounted on the bucket upon engagement of said at least one hook rod and said bucket and said securing system and said bucket;

whereby upon operating the arm of the excavator to tilt the bucket forward and lower the bucket said at least one scraper blade scrapes brush and debris from the ground; and whereby upon operating the arm of the excavator to lift the bucket and tilt the bucket downward, said rake engages the brush and debris and upon closing the grasping thumb of the bucket, the brush and debris is grasped for lifting and transferring to a place of disposal.

2. The scraper and rake attachment of claim 1, said at least one bucket engagement hook rod comprising two spaced bucket engagement hooks.

3. The scraper and rake attachment of claim 1, said mounting bracket is laterally elongate in configuration, said securing system comprising a winch and winch bracket mounted on end portion of said mounting bracket, a bucket mounted strap receiver mounted centrally on the bucket, a strap shackle and bracket mounted on the other end portion of said mounting bracket, and a mounting strap fastened to said strap shackle, running through said bucket mounted strap receiver and mounted on said winch for winching said scraper and rake attachment in place over said bucket front blade.

4. The scraper and rake attachment of claim 1, wherein said at least one scraping blade comprises a saw-tooth blade.

5. The scraper and rake attachment of claim 4, wherein said at least one scraping blade comprises two saw-tooth blades having mutually offset teeth.

6. The scraper and rake attachment of claim 1, wherein said at least one scraping blade comprises a straight blade.

7. The scraper and rake attachment of claim 6, wherein said at least one scraping blade comprises a spike tooth rake blade having spaced spike teeth extending outward therefrom.

8. The scraper and rake attachment of claim 7, wherein said at least one scraping blade further comprises a saw-tooth blade.

9. The scraper and rake attachment of claim 6, wherein said at least one scraping blade further comprises a saw-tooth blade.

10. The scraper and rake attachment of claim 1, wherein said securing system comprises a pair of spaced cables, each said cable having shackle and shackle mount at a respective lower end attached to said mounting bracket, said bucket having a pivot latch handle and securing latch attached thereto, said upper ends of said cables being attached to said pivot latch handles, respectively, whereby, upon rotation of said pivot handles upward said cables pull said scraper and rake attachment into position on said bucket, and upon latching said handles in said securing latches said scraper and rake attachment is secured in position for use.

11. The scraper a rake attachment of claim 1, wherein said at least one scraping blade is removably mounted by fasteners.

12. A scraper and rake attachment for excavator bucket, comprising:

a laterally disposed rake having a plurality of spaced teeth having an upper tooth attachment back portions, rear attachment portions, and downwardly extending teeth, and a rear support plate, said upper tooth portions being attached along said rear support plate;

a laterally disposed attachment box having an upper wall and forward and rear mounting walls, said tooth back portions being attached along said upper wall of said attachment box;

at least one scraping blade mounted to one of said forward and rear mounting walls;

a pair of spaced bucket engagement hook rods, each having a shank attached perpendicularly to said rake tooth rear support plate and overlapping said rear mounting wall, said hook rod extending over the entrance blade of the bucket;

a mounting bracket centrally attached to said shank of said at least one bucket engagement hook and spaced from said rake; and a securing system mounted to said mounting bracket and the upper forward portion of said bucket;

said mounting bracket being laterally elongate in configuration;

said securing system comprising:

a winch;

a winch bracket mounted on end portion of said mounting bracket;

a bucket mounted strap receiver mounted centrally on the bucket;

a strap shackle and bracket mounted on the other end portion of said mounting bracket; and a mounting strap fastened to said strap shackle, running through said bucket mounted strap receiver and mounted on said winch for winching said scraper and rake attachment in place over said bucket front blade;

whereby, said scraper and rake system is mounted on the bucket upon engagement of said pair of hook rods and said bucket and said securing system and said bucket;

whereby upon operating the arm of the excavator to tilt the bucket forward and lower the bucket said at least one scraper blade scrapes brush and debris from the ground; and whereby upon operating the arm of the excavator to lift the bucket and tilt the bucket downward, said rake engages the brush and debris and upon closing the grasping thumb of the bucket, the brush and debris is grasped for lifting and transferring to a place of disposal.

13. The scraper and rake attachment of claim 12, said mounting bracket is laterally elongate in configuration, said securing system comprising a winch and winch bracket mounted on end portion of said mounting bracket, a bucket mounted strap receiver mounted centrally on the bucket, a strap shackle and bracket mounted on the other end portion of said mounting bracket, and a mounting strap fastened to said strap shackle, running through said bucket mounted strap receiver and mounted on said winch for winching said scraper and rake attachment in place over said bucket front blade.

14. The scraper and rake attachment of claim 12, wherein said at least one scraping blade comprises a saw-tooth blade.

15. The scraper and rake attachment of claim 14, wherein said at least one scraping blade comprises two saw-tooth blades having mutually offset teeth.

16. The scraper and rake attachment of claim 12, wherein said at least one scraping blade comprises a straight blade.

17. The scraper and rake attachment of claim 16, wherein said at least one scraping blade comprises a spike tooth rake blade having spaced spike teeth extending outward therefrom.

18. A scraper and rake attachment for excavator bucket, comprising:

a laterally disposed rake having a plurality of spaced teeth having an upper tooth attachment back portions, rear attachment portions, and downwardly extending teeth, and a rear support plate, said upper tooth portions being attached along said rear support plate;

a laterally disposed attachment box having an upper wall and forward and rear mounting walls, said tooth back portions being attached along said upper wall of said attachment box;

a saw-tooth scraping blade mounted to each of said forward and said rear mounting wall and having mutually offset teeth;

at least one bucket engagement hook rod having a shank attached perpendicularly to said rake tooth rear support plate and overlapping said rear mounting wall, said hook rod extending over the entrance blade of the bucket;

a mounting bracket centrally attached to said shank of said at least one bucket engagement hook and spaced from said rake; and a securing system mounted to said mounting bracket and the upper forward portion of said bucket;

whereby, said scraper and rake system is mounted on the bucket upon engagement of said at least one hook rod and said bucket and said securing system and said bucket;

whereby upon operating the arm of the excavator to tilt the bucket forward and lower the bucket said saw-tooth scraper blades scrape brush and debris from the ground; and whereby upon operating the arm of the excavator to lift the bucket and tilt the bucket downward, said rake engages the brush and debris and upon closing the grasping thumb of the bucket, the brush and debris is grasped for lifting and transferring to a place of disposal.

19. The scraper a rake attachment of claim 18, wherein said at least one of said scraping blades is removably mounted by fasteners.

20. The scraper and rake attachment of claim 18, said mounting bracket being laterally elongate in configuration, said securing system comprising a winch and winch bracket mounted on an end portion of said mounting bracket, a bucket mounted strap receiver mounted centrally on the bucket, a strap shackle and bracket mounted on the other end portion of said mounting bracket, and a mounting strap fastened to said strap shackle, running through said bucket mounted strap receiver and mounted on said winch for winching said scraper and rake attachment in place over said bucket front blade.

* * * * *